US007237727B2

(12) United States Patent
Wang

(10) Patent No.: US 7,237,727 B2
(45) Date of Patent: Jul. 3, 2007

(54) PAINT SPRAY GUN

(76) Inventor: Hsing-Tzu Wang, No. 80, Ta-Hsin St., Hsi Dist., Taichung City (TW)

( * ) Notice: Subject to any disclaimer, the term of this patent is extended or adjusted under 35 U.S.C. 154(b) by 0 days.

(21) Appl. No.: 11/404,362

(22) Filed: Apr. 13, 2006

(65) Prior Publication Data

US 2006/0186223 A1 Aug. 24, 2006

Related U.S. Application Data

(63) Continuation-in-part of application No. 10/854,599, filed on May 26, 2004, now abandoned.

(51) Int. Cl.
*B05B 1/28* (2006.01)

(52) U.S. Cl. ..... 239/291; 239/290; 239/296; 239/526

(58) Field of Classification Search ..... 239/291, 239/292, 293, 296, 297, 298, 290, 526
See application file for complete search history.

(56) References Cited

U.S. PATENT DOCUMENTS 2,070,696 A * 2/1937 Tracy ..... 239/8
2,646,314 A * 7/1953 Peeps ..... 239/296
3,252,657 A * 5/1966 Winegar ..... 239/296
4,767,057 A * 8/1988 Degli et al. ..... 239/296
4,961,536 A * 10/1990 Correard ..... 239/296
5,251,822 A * 10/1993 Wang ..... 239/346

* cited by examiner

*Primary Examiner*—Kevin Shaver
*Assistant Examiner*—Jason Boeckmann
(74) *Attorney, Agent, or Firm*—Caesar, Rivise, Bernstein, Cohen & Pokotilow, Ltd.

(57) ABSTRACT

A paint spray gun has a spray cap that is disposed in front of a nozzle of a gun body, and that is formed with a central spray hole, a set of mist forming holes, a set of mist controlling holes, a pair of horn projections, and a pair of orifices. Each horn projection is formed with an air passageway, which terminates in first and second outlet openings that are oriented in different directions relative to the central spray hole. Pressurized air that flows through the nozzle exits the spray cap at the mist forming holes, the mist controlling holes, the orifices, and the first and second outlet openings in the horn projections. Paint material is drawn but of a paint canister and flows through a nozzle orifice in the nozzle and the central spray hole in the spray cap for atomization.

7 Claims, 9 Drawing Sheets

PAINT SPRAY GUN

CROSS-REFERENCE TO RELATED APPLICATION

This application is a continuation-in-part (CIP) of U.S. patent application Ser. No. 10/854,599, entitled "PAINT SPRAY GUN", filed on May 26, 2004, and abandoned as of the filing date of this application.

BACKGROUND OF THE INVENTION

1. Field of the Invention

The invention relates to a paint spray gun, more particularly to a paint spray gun that can improve efficiency of a paint spraying operation.

2. Description of the Related Art

Referring to FIGS. 1 and 2, a conventional paint spray gun 1 is shown to include a gun body 11, an operating unit 12, and a spray cap 13.

The gun body 11 has a handle portion 111, a head portion 112 connected to the handle portion 111, and a nozzle 113 mounted on one end of the head portion 112. The nozzle 113 is formed with a nozzle orifice 114. The head portion 112 is formed with a material passageway 115 that is in fluid communication with the nozzle orifice 114 and that provides a path for flow of paint material from a paint canister (not shown) to the nozzle orifice 114. The nozzle 113 is further formed with a first air passageway 116 that is fluidly isolated from the nozzle orifice 114. The gun body 11 is further formed with a second air passageway 117 that extends from the handle portion 111 and along the head portion 112, that is in fluid communication with the first air passageway 116, and that provides a path for flow of pressurized air from a compressed air source (not shown) to the first air passageway 116.

The operating unit 12 is mounted on the gun body 11, and includes a material flow controlling valve 121 for controlling the flow of the paint material through the nozzle orifice 114, an air flow controlling valve 123 for controlling the flow of the pressurized air through the second air passageway 117, a trigger 122 coupled operably to and controlling opening and closing actions of the material flow controlling valve 121 and the air flow controlling valve 123, and an air flow regulator 124 for regulating air flow through the second air passageway 117.

The spray cap 13 includes a cap body 131. The cap body 131 is disposed in front of the nozzle 113, and is formed with a central spray hole 132, two pairs of mist forming holes 133, and a pair of horn projections 134. The central spray hole 132 has a hole axis (z) extending in a longitudinal direction, and is registered and in fluid communication with the nozzle orifice 114. The mist forming holes 133 in each pair are opposite to each other in a diametrical direction (r) relative to the hole axis (z), and are disposed on opposite sides of the central spray hole 132. The horn projections 134 extend from the cap body 131 in the longitudinal direction away from the nozzle 113, and are disposed adjacent to the mist forming holes 133. Each horn projection 134 is formed with a third air passageway 1340. The third air passageway 1340 terminates in an outlet opening 135 that is formed in a lateral side, which faces toward the central spray hole 132, of the corresponding horn projection 134. The mist forming holes 133 and the third air passageways 1340 are in fluid communication with the first air passageway 116. Since the mist forming holes 133 are formed in a convex wall part of the cap body 131, the mist forming holes 133 do not appear to be disposed on a straight line in FIG. 2, but are actually disposed on a curved line and are aligned in the diametrical direction (r).

In use, when the trigger 122 of the operating unit 12 is operated to open the air flow controlling valve 123, pressurized air from the compressed air source (not shown) flows through the second air passageway 117, the first air passageway 116, and exits through the mist forming holes 133 and the outlet openings 135, thus creating a negative air pressure around the central spray hole 132. Since operation of the trigger 122 also results in opening of the material flow controlling valve 121, the paint material is drawn out of the paint canister (not shown) via the material passageway 115, and exits through the central spray hole 132, where it will be atomized by the pressurized air stream that exits through the mist forming holes 133 and the outlet openings 135 such that the paint material can be sprayed on a target surface.

However, due to the high velocity of the pressurized air stream, a portion of the atomized paint material is likely to bounce off the target surface, thereby polluting the work environment and resulting in wasted paint material.

Referring to FIG. 3, based on actual tests using the conventional paint spray gun 1, when the air stream pressure at the vicinity of the central spray hole 132 ranges between 27 to 40 psi, only 35% to 40% of the atomized paint material adheres to the target surface to form an effective painted area (A). The remainder of the atomized paint material is either scattered to the ambient air, or spread on the target surface within a spread distance (D) from the effective painted area (A) to form an ineffective painted area (B).

Referring to FIG. 4, when the air stream pressure at the vicinity of the central spray hole 132 is reduced to below 10 psi, such as by operating the air flow regulator 124 or by using a high volume low pressure (HVLP) paint spray gun, up to 60% of the atomized paint material adheres to the target surface to form the effective painted area (A), and the amount of the atomized paint material that scatters to the ambient air or that forms the ineffective painted area (B) is accordingly reduced. However, due to the reduction in the air stream pressure, the atomizing efficiency is lowered such that the painted area has a coarse surface and lacks luster.

U.S. Pat. No. 3,252,657 discloses a spray gun air cap provided with a central orifice and a pair of cap orifices respectively disposed on opposite sides of the central orifice. The spray gun air cap further has a pair of lugs on opposite sides of the cap orifices. Each lug is provided with a conduit, a lug orifice for directing air into the stream of fluid emanating from the central orifice, and a set of orifices for spreading air fanwise parallel to the fluid stream to form an air envelope to minimize over-spray. However, since the lugs, the cap orifices and the central orifices are aligned along a first diametrical direction relative to the central orifice, control of over-spray along a second diametrical direction transverse to the first diametrical direction is poor.

U.S. Pat. No. 2,070,696 discloses a spray head formed with a central orifice, a pair of first orifices on opposite sides of and aligned with the central orifice in a first diametrical direction, and a pair of second orifices on opposite sides of and aligned with the central orifice in a second diametrical direction transverse to the first diametrical direction. However, air streams coming out of the first and second orifices are for atomizing a spray stream from the central orifice and do not form an air barrier that could minimize scattering of the spray stream and reduce over-spray.

SUMMARY OF THE INVENTION

Therefore, the object of the present invention is to provide a paint spray gun that can overcome the aforesaid drawbacks associated with the prior art.

Accordingly, a paint spray gun of this invention comprises a gun body, an operating unit, and a spray cap.

The gun body has a handle portion, a head portion connected to the handle portion, and a nozzle mounted on the head portion. The nozzle is formed with a nozzle orifice. The gun body is formed with a material passageway that is in fluid communication with the nozzle orifice and that provides a path for flow of paint material to the nozzle orifice. The nozzle is further formed with a first air passageway that is fluidly isolated from the nozzle orifice. The gun body is further formed with a second air passageway that is in fluid communication with the first air passageway and that provides a path for flow of pressurized air from a compressed air source to the first air passageway.

The operating unit is mounted on the gun body, and includes a material flow controlling valve for controlling the flow of the paint material through the nozzle orifice, an air flow controlling valve for controlling the flow of the pressurized air through the second air passageway, and a trigger coupled operably to and controlling opening and closing actions of the material flow controlling valve and the air flow controlling valve.

The spray cap includes a cap body. The cap body is disposed in front of the nozzle, and is formed with a central spray hole, at least a pair of mist forming holes, a pair of horn projections, a pair of mist controlling holes, and a pair of orifices. The central spray hole has a hole axis extending in a longitudinal direction, and is registered and in fluid communication with the nozzle orifice. The mist forming holes are opposite to each other in a first diametrical direction relative to the hole axis, and are disposed on opposite sides of the central spray hole. The horn projections extend from the cap body in the longitudinal direction away from the nozzle, and are disposed adjacent to the mist forming holes. Each of the horn projections has a root end that is connected to the cap body, a tip end that is opposite to the root end in the longitudinal direction, and a lateral side that extends between the root and tip ends and that faces toward the central spray hole. Each of the horn projections is formed with a third air passageway. The third air passageway terminates in at least a first outlet opening that is formed in the lateral side, and a second outlet opening that is formed in the tip end. The mist controlling holes are opposite to each other in a second diametrical direction relative to the hole axis, and are disposed on opposite sides of the central spray hole. The second diametrical direction forms an angle with the first diametrical direction. The orifices are opposite to each other in the second diametrical direction relative to the hole axis, and are disposed on opposite sides of the central spray hole. Each of the orifices is disposed between the central spray hole and a respective one of the mist controlling holes. The mist forming holes, the third air passageways in the horn projections, the mist controlling holes, and the orifices are in fluid communication with the first air passageway.

The paint material that flows out of the paint orifice is atomized by the pressurized air that flows out of the first outlet openings in the horn projections and the mist forming holes. The pressurized air that flows out of the second outlet openings in the horn projections and the mist controlling holes forms an air barrier around the atomized paint material to control dimensions of an area to be painted by the atomized paint material.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
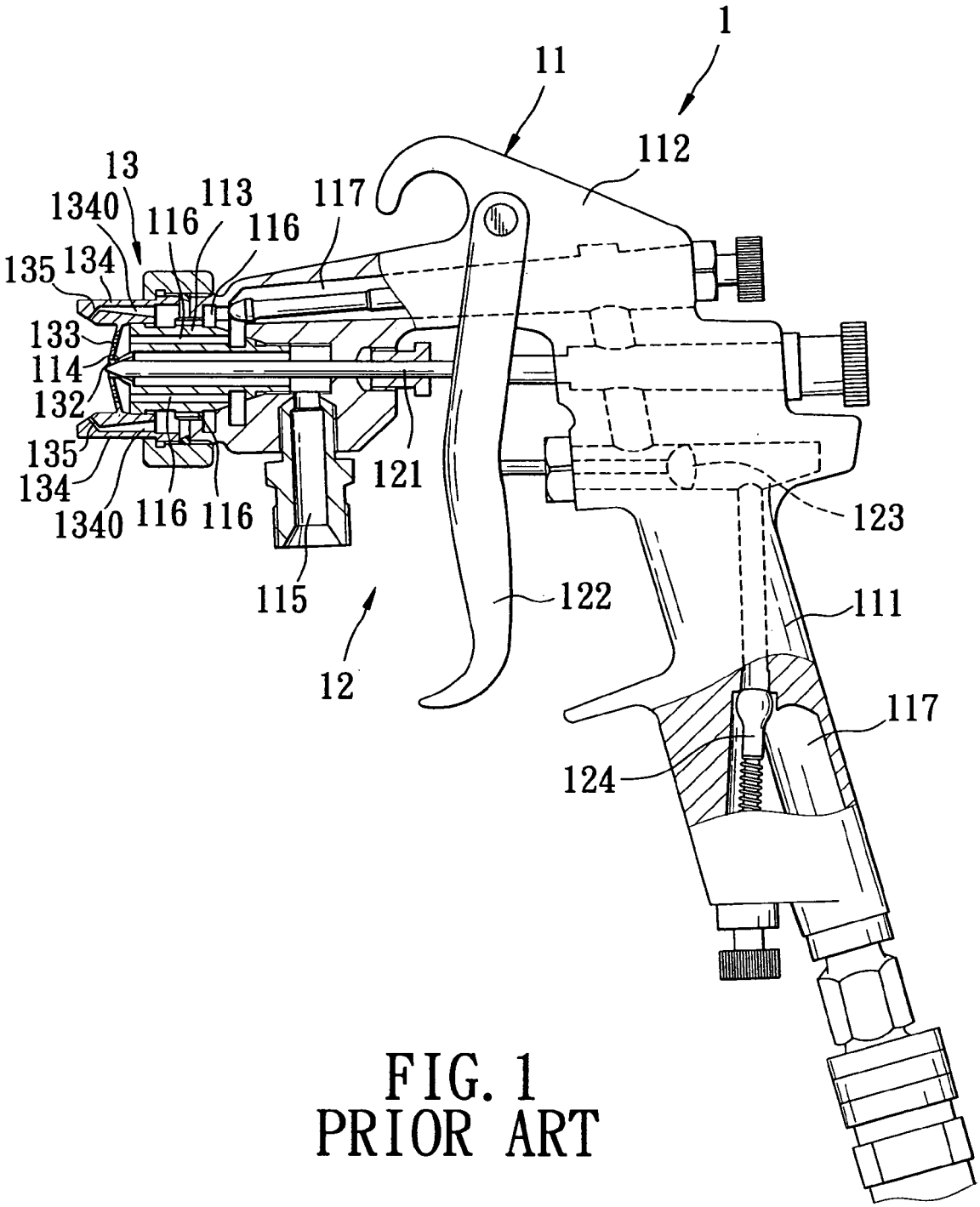
FIG. 1 PRIOR ART
FIG. 1 is a partly sectional schematic view of a conventional paint spray gun.
Figure 2:
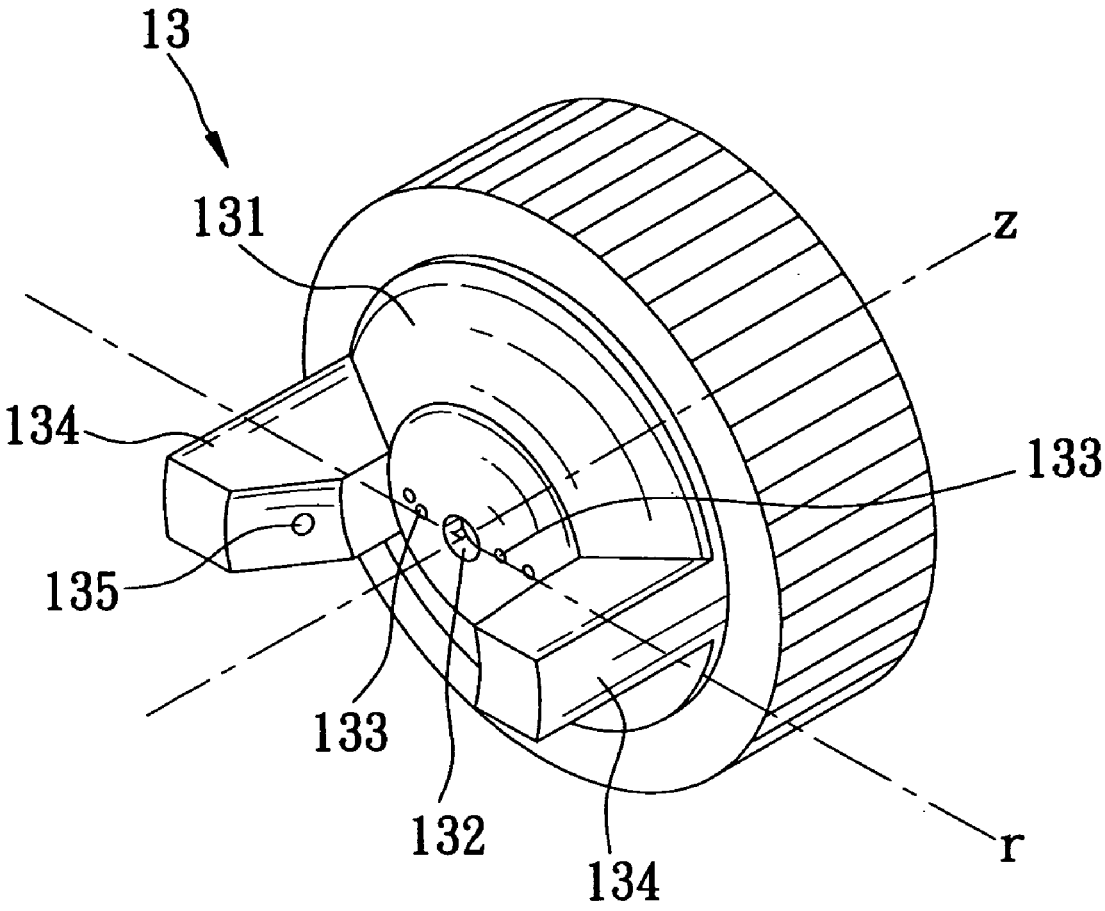
FIG. 2 PRIOR ART
FIG. 2 is a perspective view of a spray cap of the conventional paint spray gun of FIG. 1.
Figure 3:
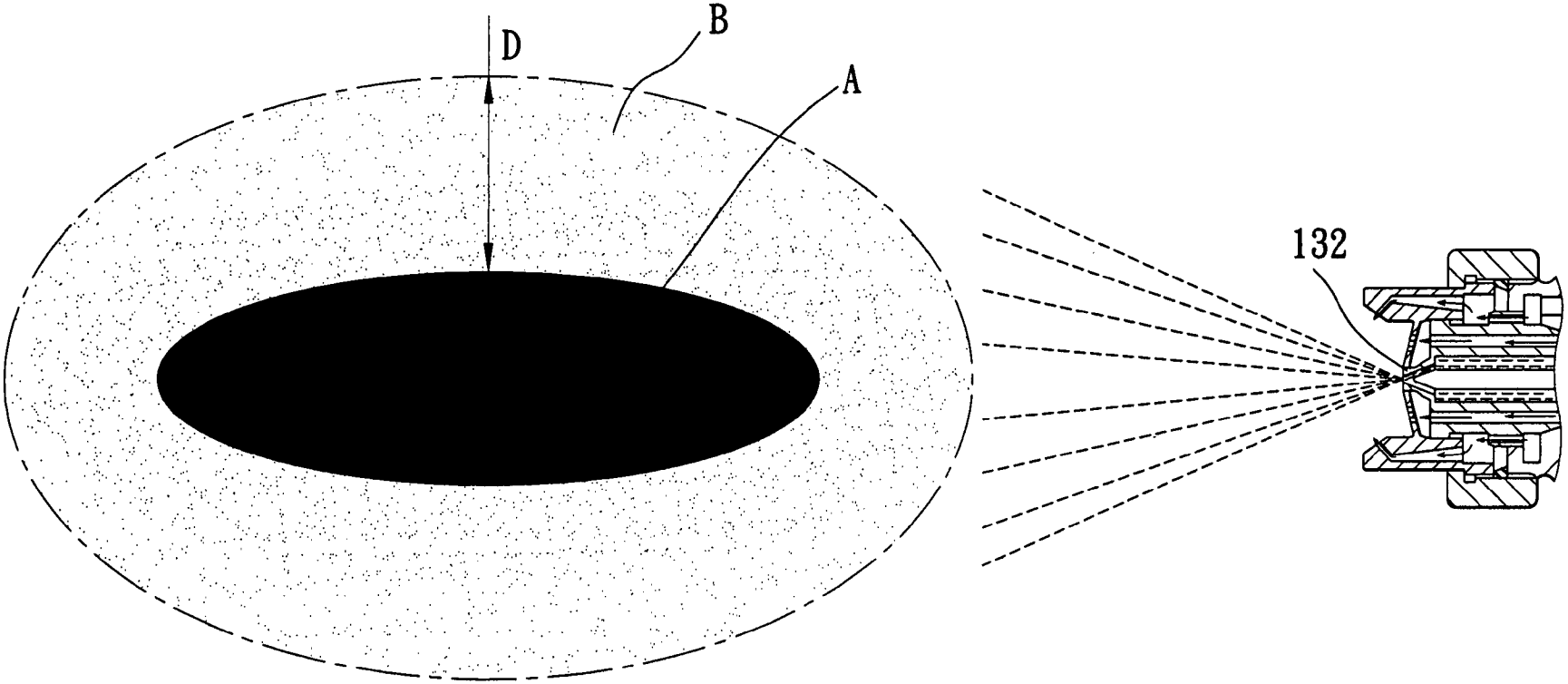
FIG. 3 PRIOR ART
FIG. 3 illustrates result of a paint spraying operation conducted using the conventional paint spray gun under high air stream pressure conditions.
Figure 4:
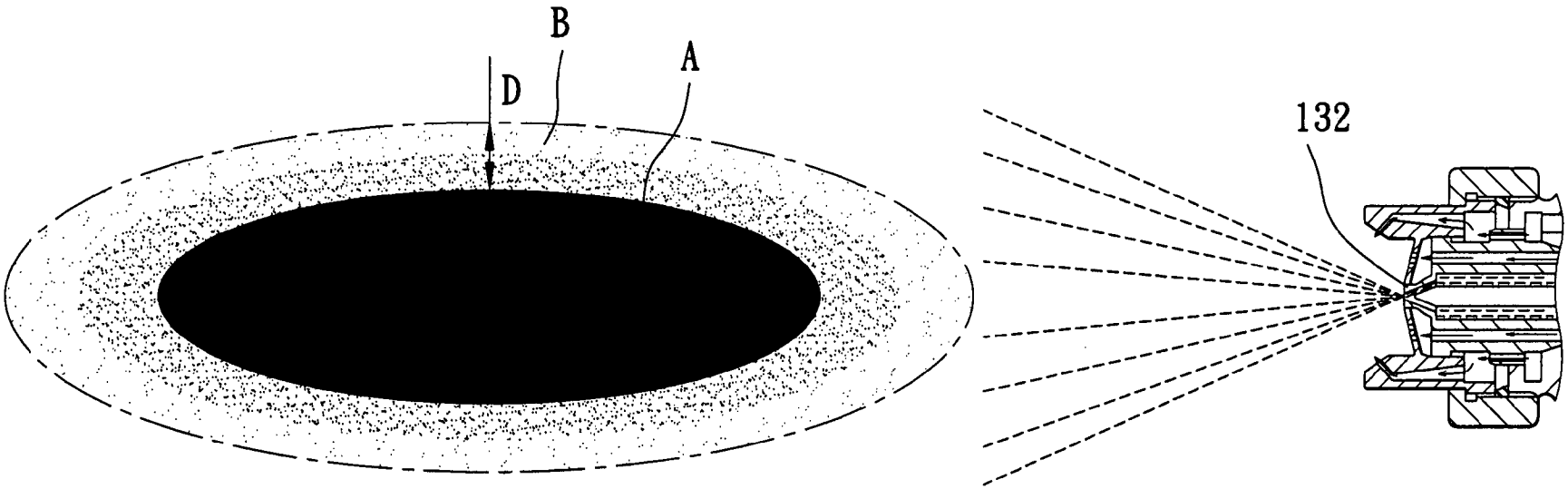
FIG. 4 PRIOR ART
FIG. 4 illustrates result of a paint spraying operation conducted using the conventional paint spray gun under low air stream pressure conditions.
Figure 5:
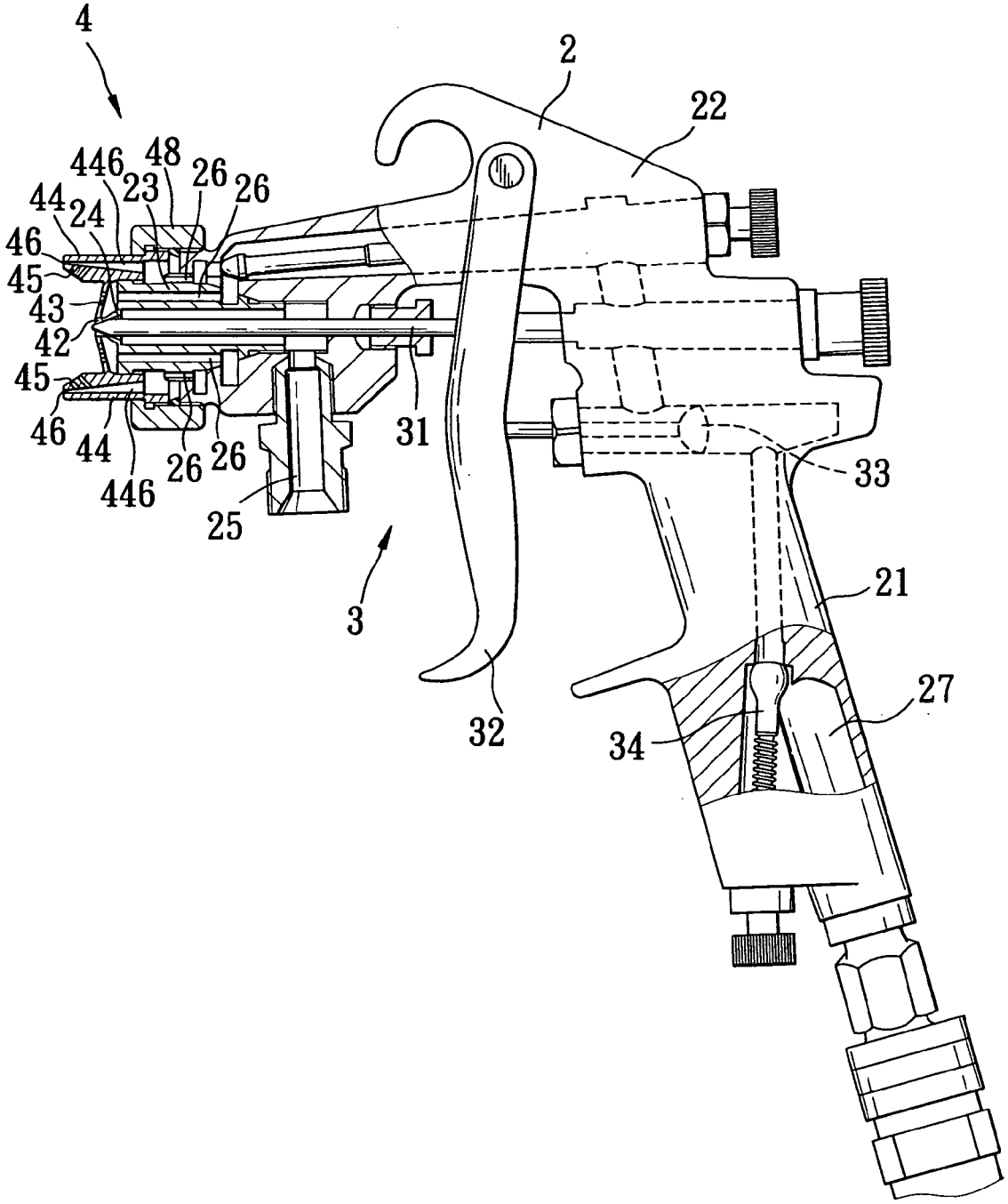
FIG. 5 is a partly sectional schematic view of the preferred embodiment of a paint spray gun according to the present invention.
Figure 6:
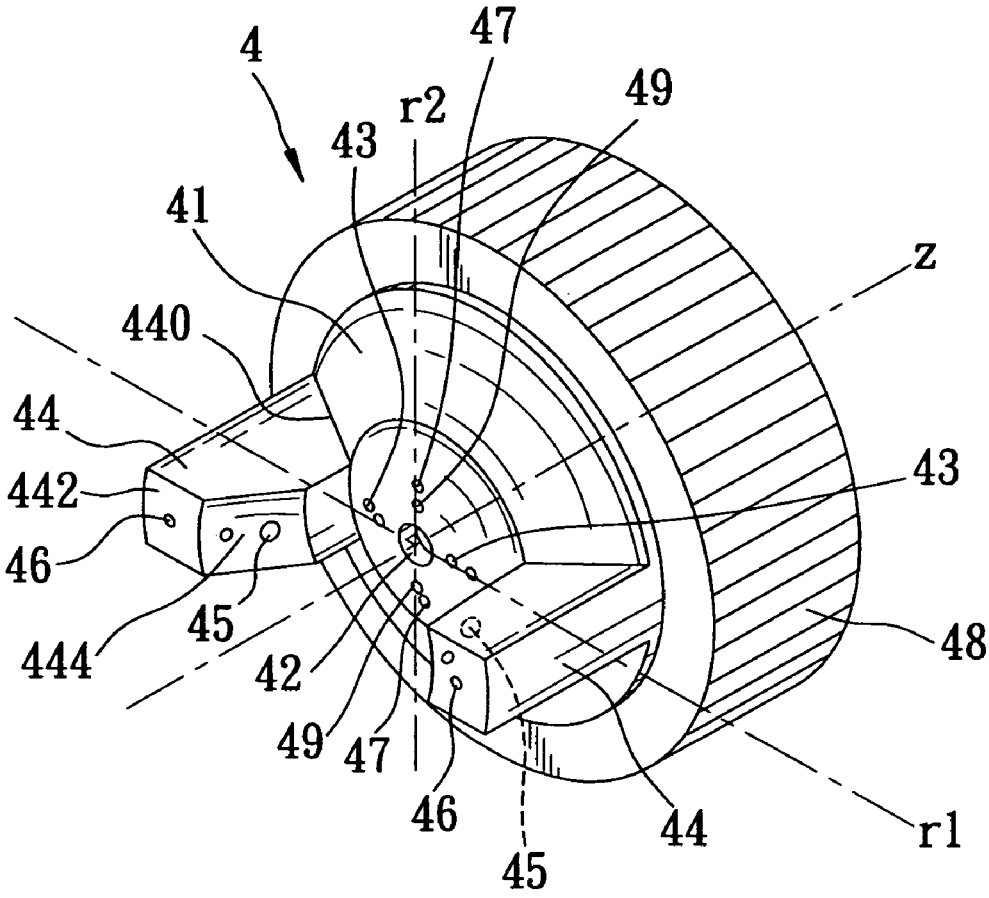
FIG. 6 is a perspective view of a spray cap of the preferred embodiment.
Figure 7:
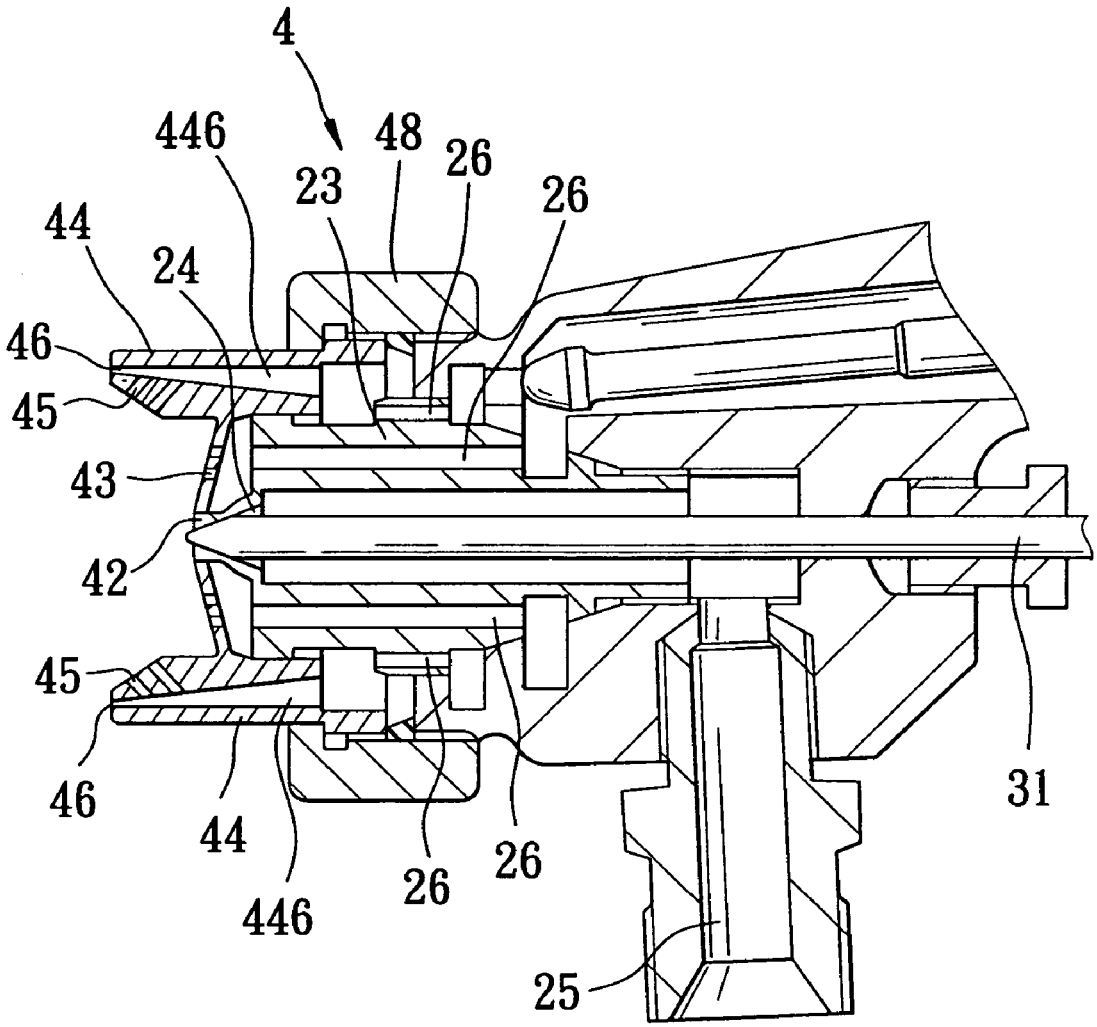
FIG. 7 is an enlarged fragmentary sectional view of the preferred embodiment.

Referring to FIGS. 5, 6 and 7, the preferred embodiment of a paint spray gun according to the present invention is shown to include a gun body 2, an operating unit 3, and a spray cap 4.

The gun body 2 has a handle portion 21, a head portion 22 connected to the handle portion 21, and a nozzle 23 mounted on the head portion 22. The nozzle 23 is formed with a nozzle orifice 24. The head portion 22 is formed with a material passageway 25 that is in fluid communication with the nozzle orifice 24 and that provides a path for flow of paint material from a paint canister (not shown) to the nozzle orifice 24. The nozzle 23 is further formed with a first air passageway 26 that is fluidly isolated from the nozzle orifice 24. The gun body 2 is further formed with a second air passageway 27 that extends from the handle portion 21 and along the head portion 22, that is in fluid communication with the first air passageway 26, and that provides a path for flow of pressurized air from a compressed air source (not shown) to the first air passageway 26.

The operating unit 3 is mounted on the gun body 2, and includes a material flow controlling valve 31 for controlling the flow of the paint material through the nozzle orifice 24, an air flow controlling valve 33 for controlling the flow of the pressurized air through the second air passageway 27, a trigger 32 coupled operably to and controlling opening and closing actions of the material flow controlling valve 31 and the air flow controlling valve 33, and an air flow regulator 34 for regulating air flow through the second air passageway 27.

Since the feature of the present invention does not reside in the specific configurations of the gun body 2 and the operating unit 3, which are similar to those of the conventional paint spray gun, they will not be described further herein for the sake of brevity.

The spray cap 4 includes a cap body 41. The cap body 41 is disposed in front of the nozzle 23 (as best shown in FIG. 7), and is formed with a central spray hole 42, at least a pair of mist forming holes 43, a pair of horn projections 44, a pair of mist controlling holes 47, and a pair of orifices 49. The central spray hole 42 has a hole axis (z) that extends in a longitudinal direction, and is registered and in fluid communication with the nozzle orifice 24. In this embodiment, there are two pairs of mist forming holes 43. The mist forming holes 43 in each pair are opposite to each other in a first diametrical direction (r1) relative to the hole axis (z), and are disposed on opposite sides of the central spray hole 42. The horn projections 44 extend from the cap body 41 in the longitudinal direction away from the nozzle 23, and are disposed adjacent to the mist forming holes 43. Each of the horn projections 44 has a root end 440 that is connected to the cap body 41, a tip end 442 that is opposite to the root end 440 in the longitudinal direction, and a lateral side 444 that extends between the root and tip ends 440, 442 and that faces toward the central spray hole 42. Each of the horn projections 44 is formed with a third air passageway 446. The third air passageway 446 terminates in at least a first outlet opening 45 that is formed in the lateral side 444, and a second outlet opening 46 that is formed in the tip end 442. In this embodiment, the lateral side 444 is formed with a pair of the first outlet openings 45. The mist controlling holes 47 are opposite to each other in a second diametrical direction (r2) relative to the hole axis (z), and are disposed on opposite sides of the central spray hole 42. The second diametrical direction (r2) forms an angle with the first diametrical direction (r1). In this embodiment, the second diametrical direction (r2) is transverse to the first diametrical direction (r1). The orifices 49 are opposite to each other in the second diametrical direction (r2) relative to the hole axis (z), and are disposed on opposite sides of the central spray hole 42. Each of the orifices 49 is disposed between the central spray hole 42 and a respective one of the mist controlling holes 47. The mist forming holes 43, the third air passageways 446 in the horn projections 44, the mist controlling holes 47, and the orifices 49 are in fluid communication with the first air passageway 26. The spray cap 4 further includes a locking collar 48 that surrounds and locks removably the cap body 41 on the head portion 22 of the gun body 2.

Figure 8:
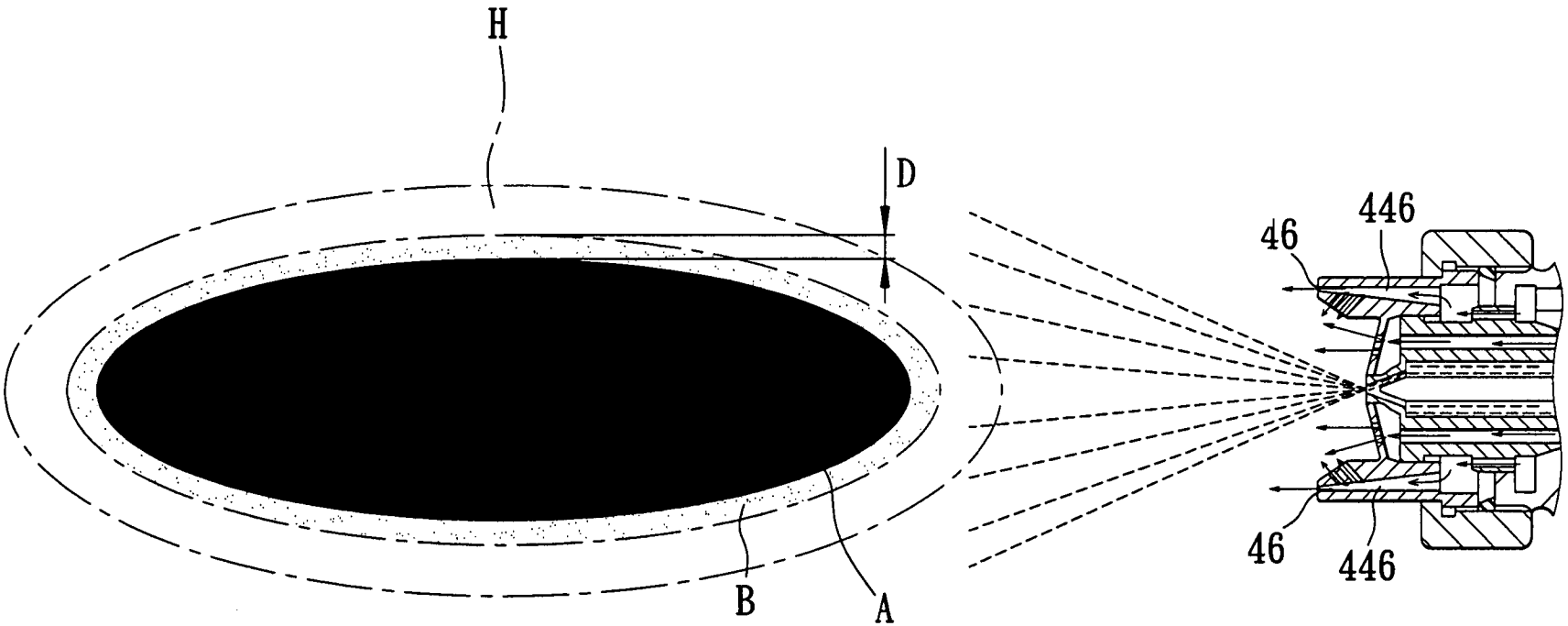
FIGS. 8 and 9 illustrate result of a spraying operation conducted using the paint spray gun of the preferred embodiment.

Referring to FIG. 8, each of the mist controlling holes 47 has a central axis (x) that intersects the hole axis (z) of the central spray hole 42 at a rear side of the cap body 41. In this embodiment, the cap body 41 has a convex wall part with the mist forming holes 43, the mist controlling holes 47 and the orifices 49 formed therethrough. The central axis (x) of each of the mist controlling holes 47 radiates outwardly from the hole axis (z) of the central spray hole 42 at the rear side (i.e., upstream side) of the cap body 41 to the downstream side of the cap body 41. Each of the orifices 49 has an axis (y) that is substantially parallel to the hole axis (z) of the central spray hole 42.

Since the mist forming holes 43 are formed in the convex wall part of the cap body 41, the mist forming holes 43 do not appear to be disposed on a straight line in FIG. 6, but are actually disposed on a curved line and are aligned in the first diametrical direction (r1). Likewise, since the mist controlling holes 47 and the orifices 49 are also formed in the convex wall part of the cap body 41, they do not appear to be disposed on a straight line in FIG. 6, but are actually disposed on a curved line and are aligned in the second diametrical direction (r2).

In use, when the trigger 32 of the operating unit 3 is operated to open the air flow controlling valve 33, pressurized air from the compressed air source (not shown) flows through the second air passageway 27, the first air passageway 26, and exits through the mist forming holes 43, the first and second outlet openings 45, 46, the mist controlling holes 47, and the orifices 49. Since a negative air pressure is created around the central spray hole 42, and since operation of the trigger 32 also results in opening of the material flow controlling valve 31, the paint material is drawn out of the paint canister (not shown) via the material passageway 25, and exits through the central spray hole 42, where it will be atomized by the pressurized air stream that flows out of the first outlet openings 45 in the horn projections 44 and the mist forming holes 43 such that the paint material can be sprayed on a target surface.

Figure 9:
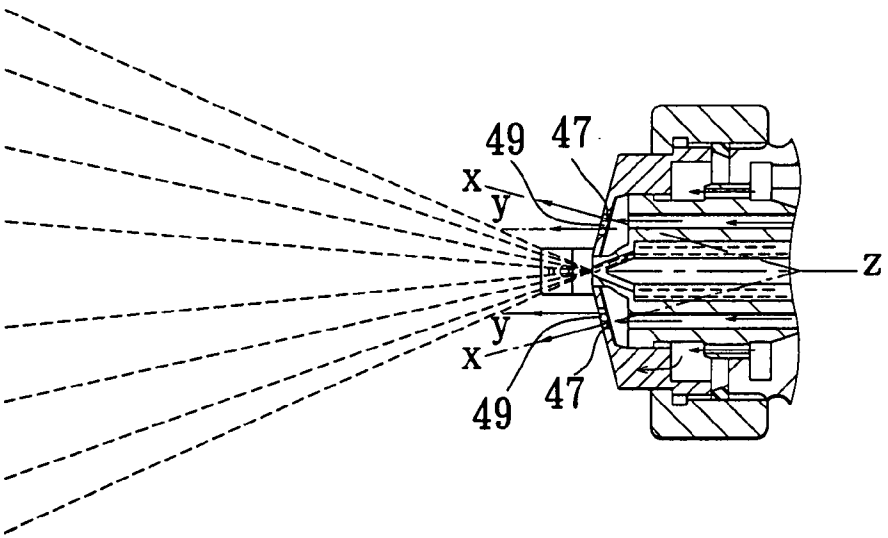
Figure 9:
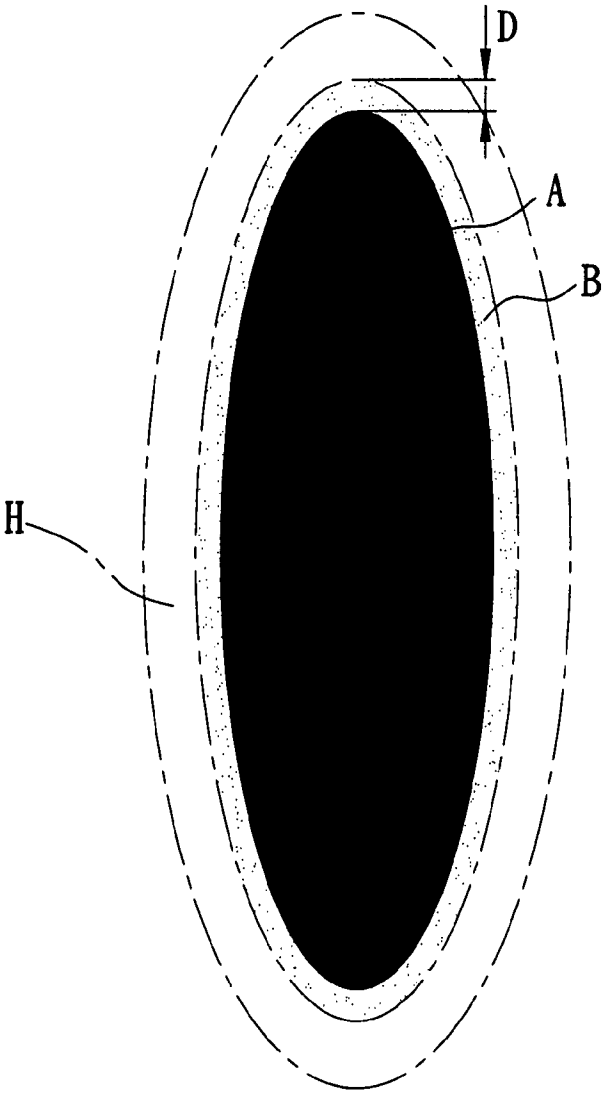

Referring to FIGS. 8 and 9, the pressurized air that flows through the second outlet openings 46 and the mist controlling holes 47 serves primarily to form an air barrier (H) around the atomized paint material to control dimensions of an area to be painted by the atomized paint material. As a result, scattering of the atomized paint material to the ambient air can be reduced, thereby increasing the effective painted area (A). The pressurized air flowing through the second outlet openings 46 and the mist controlling holes 47 controls the width and length of the effective painted area (A) As such, the ineffective painted area (B) within a spread distance (D) from the effective painted area (A) is reduced accordingly. In view of the aforesaid configuration, when the air stream pressure at the vicinity of the central spray hole 42 is increased to improve the atomizing efficiency, due to the corresponding increase in air pressure through the second outlet openings 46 and the mist controlling holes 47, a stronger air barrier (H) will be formed to minimize scattering of the atomized paint material. Therefore, pollution of the work environment and waste of the paint material can be reduced when the paint spray gun of this invention is in use.

Moreover, in view of the location of the orifices 49, which are disposed close to the central spray hole 42, the pressurized air that flows out of the orifices 49 can help control the shape of the sprayed atomized paint material.

In sum, the advantage of being able to control both the width and the length of the effective painted area (A) is achieved by providing the cap body 41 with the second outlet openings 46 and the mist controlling holes 47.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A paint spray gun comprising:

a gun body having a handle portion, a head portion connected to said handle portion, and a nozzle mounted on said head portion, said nozzle being formed with a nozzle orifice, said gun body being formed with a material passageway that is in fluid communication with said nozzle orifice and that provides a path for flow of paint material to said nozzle orifice, said nozzle being further formed with a first air passageway that is fluidly isolated from said nozzle orifice, said gun body being further formed with a second air passageway that is in fluid communication with said first air passageway and that provides a path for flow of pressurized air from a compressed air source to said first air passageway;

an operating unit mounted on said gun body and including a material flow controlling valve for controlling the flow of the paint material through said nozzle orifice, an air flow controlling valve for controlling the flow of the pressurized air through said second air passageway, and a trigger coupled operably to and controlling opening and closing actions of said material flow controlling valve and said air flow controlling valve; and a spray cap including a cap body disposed in front of said nozzle and formed with a central spray hole that has a hole axis extending in a longitudinal direction and that is registered and in fluid communication with said nozzle orifice, at least a pair of mist forming holes that are opposite to each other in a first diametrical direction relative to the hole axis and that are disposed on opposite sides of said central spray hole, a pair of horn projections that extend from said cap body in the longitudinal direction away from said nozzle and that are disposed adjacent to said mist forming holes, each of said horn projections having a root end that is connected to said cap body, a tip end that is opposite to said root end in the longitudinal direction, and a lateral side that extends between said root and tip ends and that faces toward said central spray hole, each of said horn projections being formed with a third air passageway, said third air passageway terminating in at least a first outlet opening that is formed in said lateral side, and a second outlet opening that is formed in said tip end, a pair of mist controlling holes that are opposite to each other in a second diametrical direction relative to the hole axis and that are disposed on opposite sides of said central spray hole, the second diametrical direction forming an angle with the first diametrical direction, wherein each of said mist controlling holes has a central axis that intersects the hole axis of said central spray hole at an upstream side of said cap body, and a pair of orifices that are opposite to each other in the second diametrical direction relative to the hole axis and that are disposed on opposite sides of said central spray hole, each of said orifices being disposed between said central spray hole and a respective one of said mist controlling holes, said mist forming holes, said third air passageways in said horn projections, said mist controlling holes, and said orifices being in fluid communication with said first air passageway, wherein the paint material that flows out of said central spray hole is atomized by the pressurized air that flows out of said first outlet openings in said horn projections and said mist forming holes, and wherein the pressurized air that flows out of said second outlet openings in said horn projections and said mist controlling holes forms an air barrier around the atomized paint material to control dimensions of an area to be painted by the atomized paint material.

2. The paint spray gun as claimed in claim 1, wherein the second diametrical direction is transverse to the first diametrical direction.

3. The paint spray gun as claimed in claim 1, wherein said spray cap further includes a locking collar that surrounds and locks removably said cap body on said head portion of said gun body.

4. A paint spray gun comprising:

a gun body having a handle portion, a head portion connected to said handle portion, and a nozzle mounted on said head portion, said nozzle being formed with a nozzle orifice, said gun body being formed with a material passageway that is in fluid communication with said nozzle orifice and that provides a path for flow of paint material to said nozzle orifice, said nozzle being further formed with a first air passageway that is fluidly isolated from said nozzle orifice, said gun body being further formed with a second air passageway that is in fluid communication with said first air passageway and that provides a path for flow of pressurized air from a compressed air source to said first air passageway;

an operating unit mounted on said gun body and including a material flow controlling valve for controlling the flow of the paint material through said nozzle orifice, an air flow controlling valve for controlling the flow of the pressurized air through said second air passageway, and a trigger coupled operably to and controlling opening and closing actions of said material flow controlling valve and said air flow controlling valve; and a spray cap including a cap body disposed in front of said nozzle and formed with a central spray hole that has a hole axis extending in a longitudinal, direction and that is registered and in fluid communication with said nozzle orifice, at least a pair of mist forming holes that are opposite to each other in a first diametrical direction relative to the hole axis and that are disposed on opposite sides of said central spray hole, a pair of horn projections that extend from said cap body in the longitudinal direction away from said nozzle and that are disposed adjacent to said mist forming holes, each of said horn projections having a root end that is connected to said cap body, a tip end that is opposite to said root end in the longitudinal direction, and a lateral side that extends between said root and tip ends and that faces toward said central spray hole, each of said horn projections being formed with a third air passageway, said third air passageway terminating in at least a first outlet opening that is formed in said lateral side, and a second outlet opening that is formed in said tip end, a pair of mist controlling holes that are opposite to each other in a second diametrical direction relative to the hole axis and that are disposed on opposite sides of said central spray hole, the second diametrical direction forming an angle with the first diametrical direction, and a pair of orifices that are opposite to each other in the second diametrical direction relative to the hole axis and that are disposed on opposite sides of said central spray hole, each of said orifices being disposed between said central spray hole and a respective one of said mist controlling holes, said mist forming holes, said third air passageways in said horn projections, said mist controlling holes, and said orifices being in fluid communication with said first air passageway, wherein the paint material that flows out of said central spray hole is atomized by the pressurized air that flows out of said first outlet openings in said horn projections and said mist forming holes, wherein the pressurized air that flows out of said second outlet openings in said horn projections and said mist controlling holes forms an air barrier around the atomized paint material to control dimensions of an area to be painted by the atomized paint material; and wherein said cap body has a convex wall part with said mist forming holes, said mist controlling holes and said orifices formed therethrough, each of said mist controlling holes having a central axis that radiates outwardly from the hole axis of said central spray hole at an upstream side of said cap body to the downstream side of the cap body.

5. The paint spray gun as claimed in claim 4, wherein each of said orifices has a central axis that is substantially parallel to the hole axis of said central spray hole.

6. The paint spray gun as claimed in claim 4, wherein the second diametrical direction is transverse to the first diametrical direction.

7. The paint spray gun as claimed in claim 4, wherein said spray cap further includes a locking collar that surrounds and locks removably said cap body on said head portion of said gun body.

* * * * *